US007813516B1

(12) United States Patent
Graber

(10) Patent No.: US 7,813,516 B1
(45) Date of Patent: Oct. 12, 2010

(54) SYSTEM FOR CARDIOID SOUND FIELD GENERATION FROM DISSIMILAR SOURCES

(76) Inventor: Curtis E. Graber, 9301 Roberts Rd., Woodburn, IN (US) 46797

( * ) Notice: Subject to any disclaimer, the term of this patent is extended or adjusted under 35 U.S.C. 154(b) by 1114 days.

(21) Appl. No.: 11/491,585

(22) Filed: Jul. 24, 2006

(51) Int. Cl.
*H04R 25/00* (2006.01)

(52) U.S. Cl. ..... 381/182; 381/186; 381/386

(58) Field of Classification Search ..... 381/300, 381/304, 305, 87, 89, 332, 334, 335, 336, 381/342, 182, 186, 386, 387; 181/144, 145, 181/147, 199
See application file for complete search history.

(56) References Cited

U.S. PATENT DOCUMENTS 6,016,353 A * 1/2000 Gunness ..... 381/342
2007/0110269 A1* 5/2007 Levitsky ..... 381/335

* cited by examiner

*Primary Examiner*—Huyen D Le
(74) *Attorney, Agent, or Firm*—Paul W. O'Malley

(57) ABSTRACT

Front to back linear arrays of loudspeakers provide a sound field compressed both vertical and horizontally with the horizontal directivity patter exhibiting a cardioid shape. The problem addressed is improving the horizontal directivity of linear arrays. A linear array of bass units is placed behind a linear array of mid to high frequency range devices to improve horizontal directivity. The first and second linear arrays are placed back to front, oriented to radiate in a forward direction and spaced by a known distance "d". The distance "d" may be selected to determine the degree of narrowing of the cardioid pattern sound field generated. Greater directivity is also achieved by adding additional linear arrays of bass units behind the second array. The upper frequency knee of the bass unit arrays must overlap the lower frequency knee of the mid/high-frequency unit array.

15 Claims, 7 Drawing Sheets

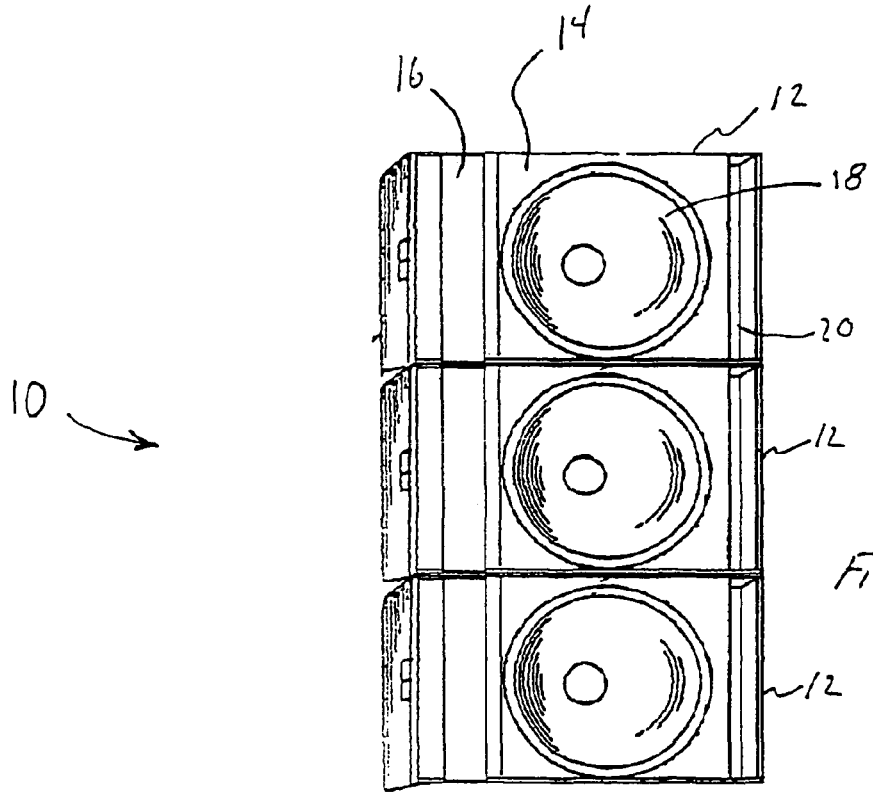
FIG. 1
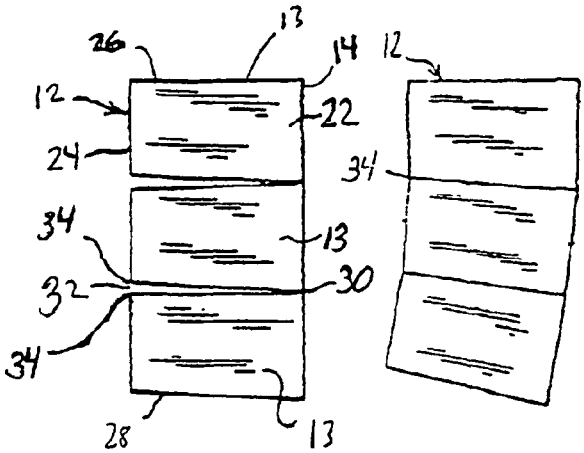
FIG. 3A
FIG. 3B

SYSTEM FOR CARDIOID SOUND FIELD GENERATION FROM DISSIMILAR SOURCES

BACKGROUND OF THE INVENTION

1. Technical Field

The invention relates to linear arrays of loudspeakers.

2. Description of the Problem

Large space, public sound systems rely on a combination of loudspeaker types to achieve efficiency, wavefront coherence, a broad and level audio frequency bandwidth and good coverage of an audience located in the space. A foundational element in many such public sound systems is a linear array of multi-transducer loudspeakers. A linear array (sometimes termed a "line array") is, in its classical form, a vertical row of closely spaced, cone type, direct-radiator acoustical drivers set in a baffle. Adjacent acoustical drivers are spaced to be mutually coupled in operation. This results in compression of the resultant sound field vertically and increases directivity of the sound field. The array can then be aimed to direct the sound field reducing the amount of energy lost to areas of less interest.

In a classic linear array the mutual coupling of the acoustic drivers results from the acoustic drivers being physically identical to one another, being used to produce the same sounds and being closely spaced. What constitutes "closely spaced" is a function of the highest audio frequency that the array is intended to produce, but roughly means that the center of each speaker cone should be spaced from the centers of adjacent cones by no more than a quarter wavelength of the highest frequency sound the array is intended to reproduce. Audible sound ranges in wavelength from about 17 meters at 20 hertz to 1.7 cm at 20 Kilohertz. The smallest direct radiator cone type speakers used are usually on the order 10 cm in diameter which allows spacing for good sound reproduction up to a frequency of about 3 Kilohertz. This provides for good speech intelligibility. The use of ribbon or planar type devices (which function essentially as linear arrays with zero spacing between elements) can be used for higher frequencies allowing higher quality reproduction of music.

While the vertical compression of the directivity pattern of the sound field generated by a linear array has long been recognized, less benefit has been obtained horizontally. Typically, the directivity pattern for a linear array has exhibited a shotgun pattern, with substantial amounts of energy being directed into two or more side-lobes. It would be desirable to generate a sound field with a directivity pattern exhibiting a cardioid shape thus directing more sound into an area corresponding with a more typical dispersal of an audience.

SUMMARY OF THE INVENTION

According to the invention an arrangement of multi-transducer linear arrays achieve improved horizontal confinement of a generated sound field. Specifically, at least first and second linear arrays are placed back to front, oriented to radiate in a forward direction and spaced by a known distance "d". The output of the more forward loudspeaker arrays is delayed to synchronize with the wave front from the array or arrays to the rear. While all of the transducer assemblies in a given array are of the same type, the assemblies are not the same from the most forward array opposed to arrays located behind the front array. More particularly, bass units are located rearwardly from the front array of mid and high frequency transducers. The upper frequency knee of the bass unit arrays must overlap the lower frequency knee of the mid/high-frequency unit arrays.

Additional effects, features and advantages will be apparent in the written description that follows.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

FIG. 1 is a frontal perspective view of several loudspeaker enclosures incorporating high and mid frequency range transducers, used in a forward linear array of a multiple linear array system.

FIGS. 3A-B is a side elevation illustrating straight and curved linear arrays.

DETAILED DESCRIPTION OF THE INVENTION

Figure 2:
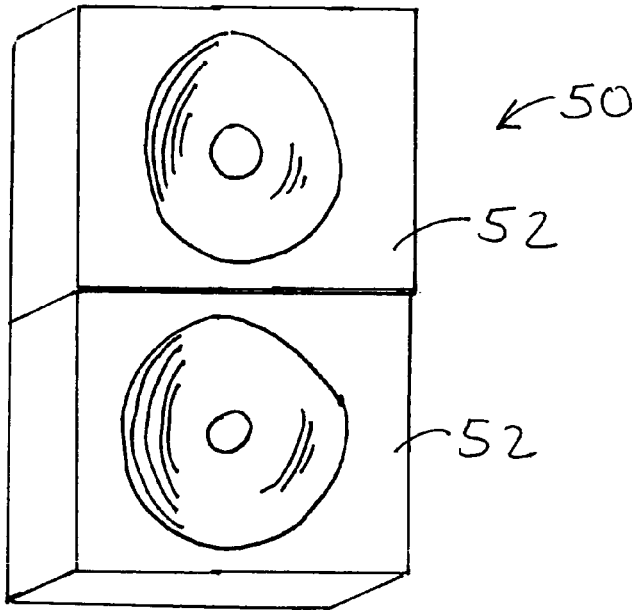
FIG. 2 is a frontal perspective view of bass units for linear arrays located behind the forward linear array.

Referring now to the figures and in particular to FIG. 1 where a linear array 10 of multi-transducer loudspeaker units 12 is arranged in vertical alignment one on top of another. Typically such arrays are disposed vertically, though they can be horizontal. Loudspeaker units 12 each have a front face 14 from which sound radiates from a high frequency planar or ribbon tweeter 16, a mid-range unit 18, and a port 20. The particular types of transducers and ports for a loudspeaker unit 12 are aligned with like elements for adjacent loudspeaker units 12. Loudspeaker units 12 are more fully described in U.S. Pat. No. 6,870,942, which is incorporated herein by reference.

Referring to FIG. 2 an array 50 of low frequency "subwoofer" loudspeaker units 52 is illustrated. As illustrated and described hereinafter, array 50 is intended to be placed tandem with and acoustically behind linear array 10.

Figure 4:
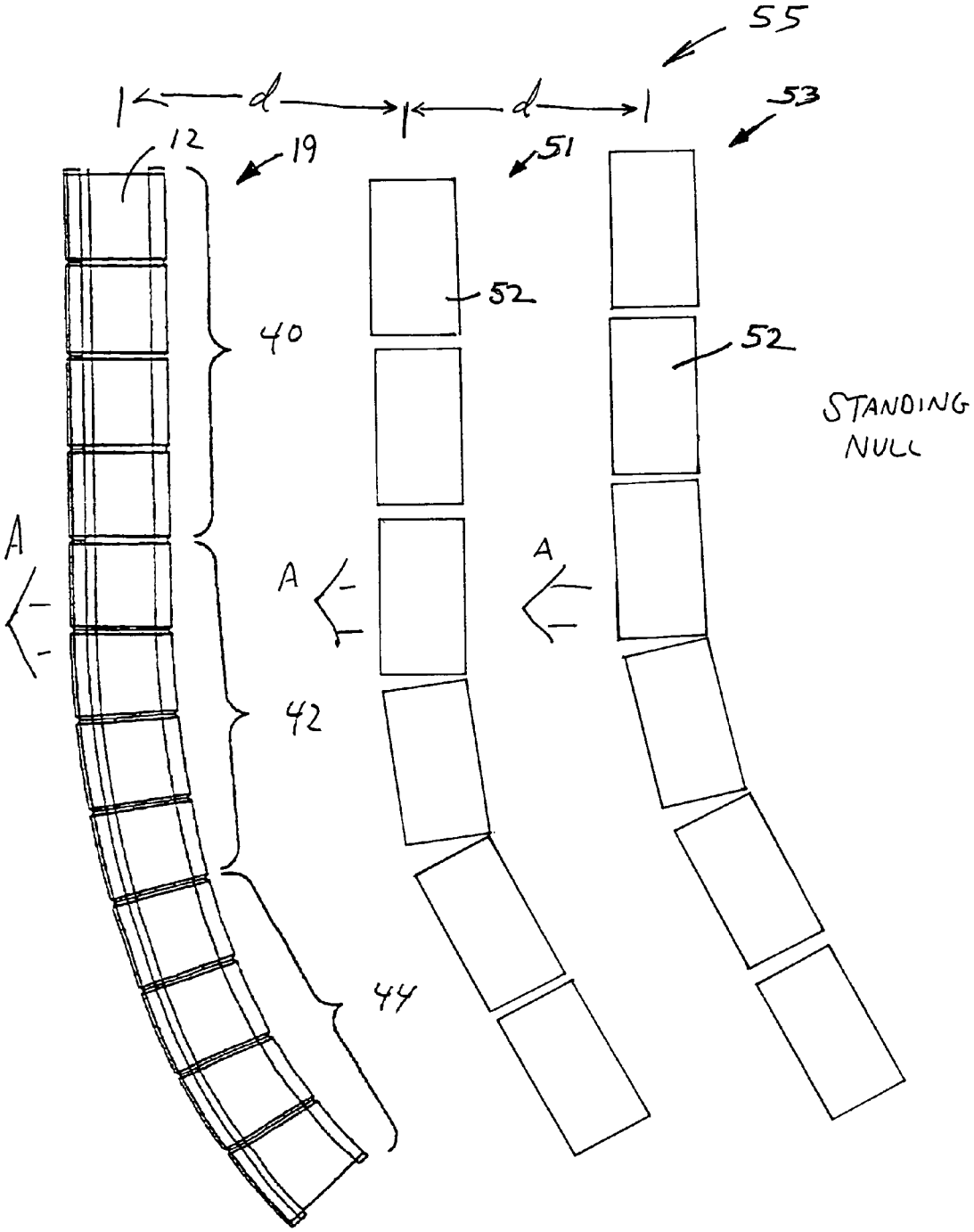
FIG. 4 is a side elevation of the system of linear arrays of the invention.

Referring to FIGS. 3A-B, loudspeaker units 12 are based on trapezoidal housings 13. By trapezoidal it is meant that the housings 13 are characterized from bases 28 and upper covers 26 which converge from front to back of the units 12. This same shape is sometimes referred to as a trapezium. The front face 14 and back wall 24 are parallel giving each housing 13 a trapezoidal appearance. The individual sides of a trapezoidal housing 13, such as side 22, are trapezoidally shaped with front and rear parallel edges and top and bottom converging sides. In practice, loudspeaker units 12 are arranged in a vertical plane, either straight up and down as shown in FIG. 3A, or in a curving manner such as shown in FIG. 3B, or, as is more typically the case where large volumes need to be covered, as a mixture of shapes (straight vertical 40, moderate curve 42, tight curve 44) as shown in FIG. 4. The more nearly straight the array, the greater the vertical compression of the sound output from the array for reaching distant portions of an audience. For any curvature, the front faces 14 meet edge to edge 34 to maintain spacing between acoustic transducers. Along the back faces 24 the units 12 may be arrayed stepwise in a curved fashion meeting along edges 34, or the units may be held vertically with a gap 32 between the trailing edges 34. Linear arrays 50 of sub-woofer units 52 may also be arranged in straight and curved sections as illustrated by linear arrays 51, 53 in FIG. 4.

Figure 5:
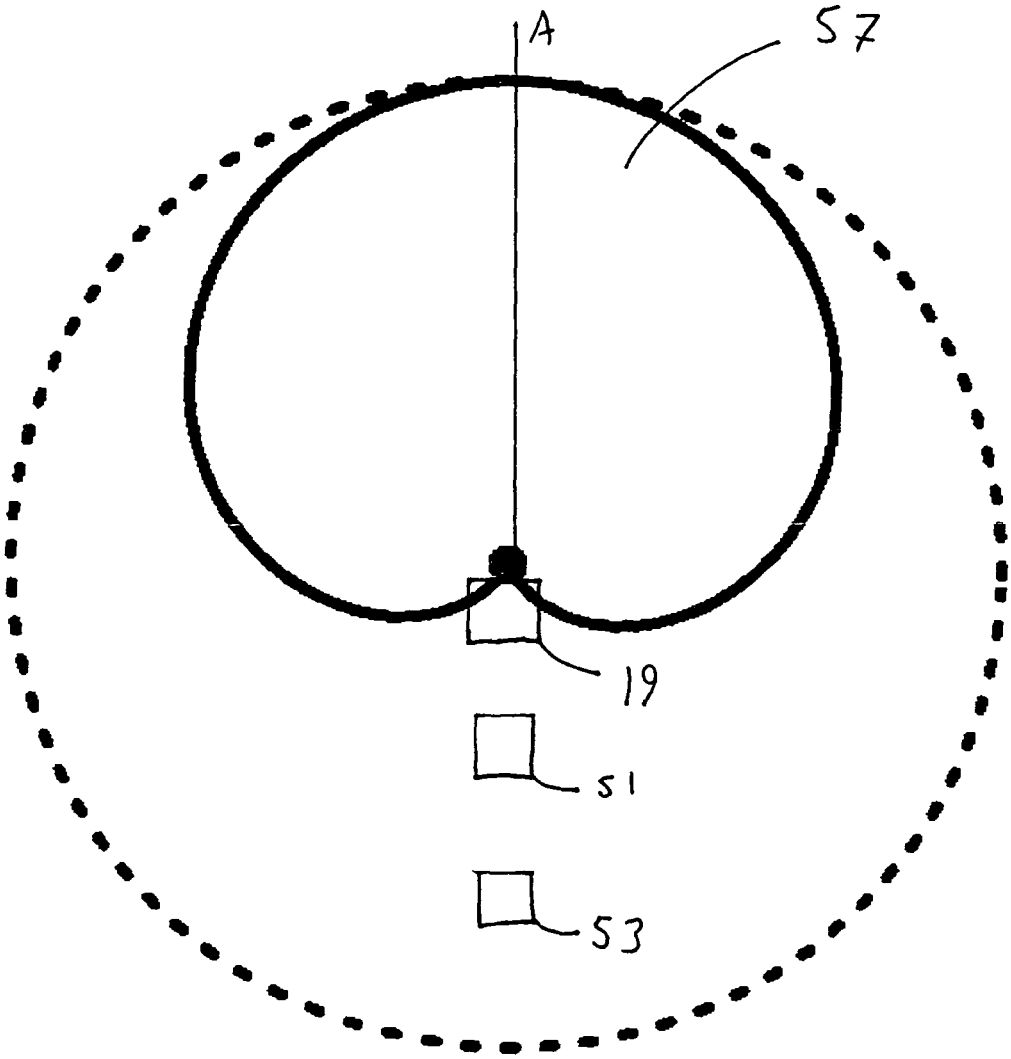
FIG. 5 is a directivity pattern illustrating the cardioid pattern generated by the system of arrays of the invention.

Referring to FIG. 4 a sound system 55 comprising three linear arrays 19, 51, 53 is illustrated. Linear arrays 19, 51, 53 are disposed one behind the other with the array comprising higher frequency transducers located forward of the other arrays. Linear array 19 comprises loudspeaker assemblies 12 which cover mid and high frequency ranges. Linear arrays 51, 53 comprise sub-woofer units 52. Loudspeaker units 12, 52 are oriented to radiate in direction "A" making linear array 19 the forward most of the arrays. The preferred embodiment of the invention is realized by using just one linear array 51 of sub-woofers 52 behind linear array 19, but the number of linear arrays of sub-woofers 52 backing the front array 19 may be multiplied as desired to achieve greater horizontal compression of the resulting cardioid radiation pattern. The distance "d" between adjacent arrays is known, and is shown being the same for the additional array added to the system for the sake of simplicity. This readily allows the sound output of the more forward arrays to be timed to match the wavefront propagating in direction A. It is not essential though that the distances between adjacent pairs of arrays be the same. An increase in the spacing between arrays 51 and 53 over that between array 19 and array 51 operates to still further narrow the forward sound field. The system produces a cardioid sound pattern 57 as illustrated in the directivity pattern of FIG. 5 with a standing null zone behind the series of arrays.

Figure 6:
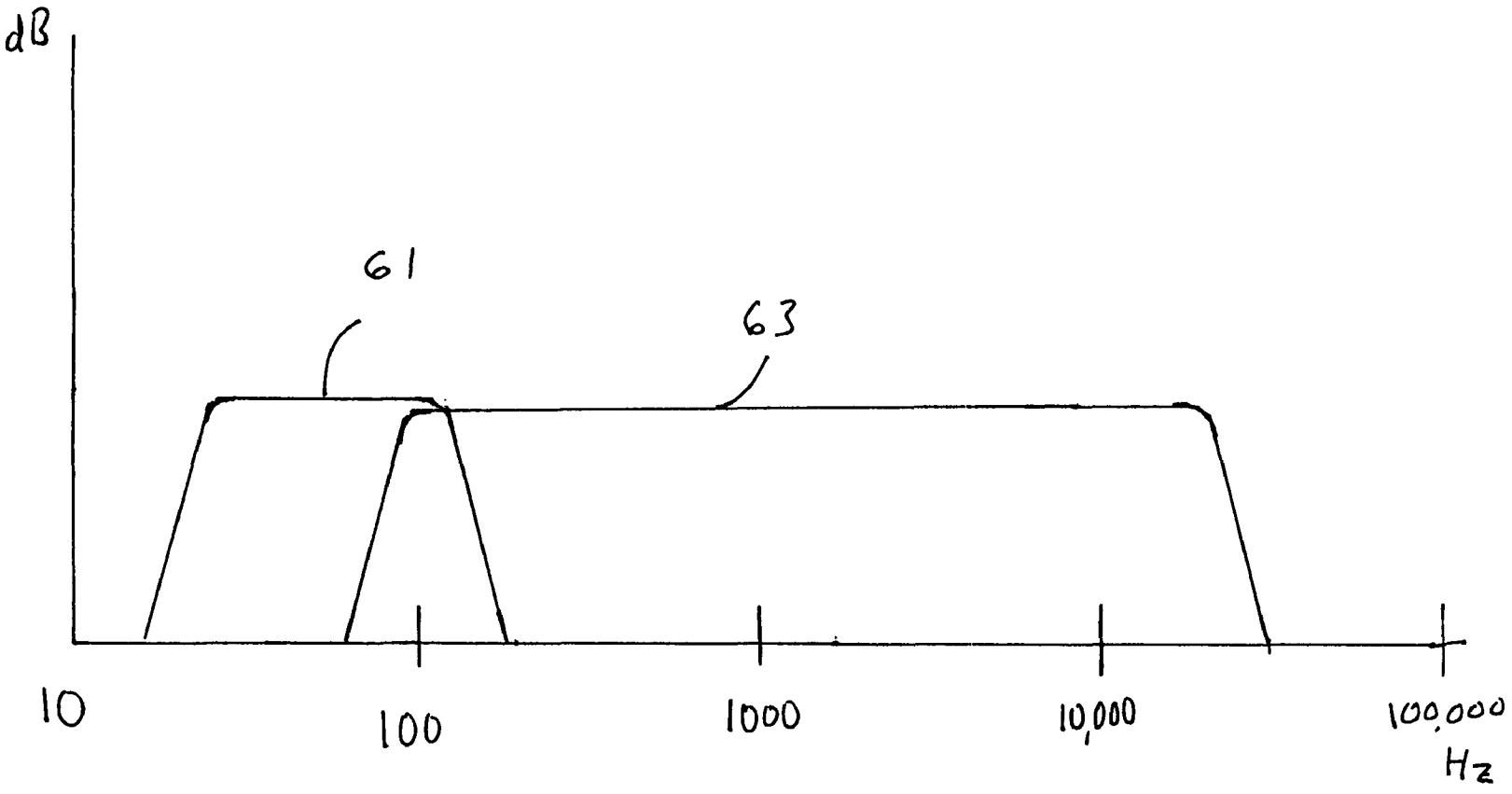
FIG. 6 is a graph of representative frequency response curves for two types of loudspeaker, used to construct the forward linear array and the one or more rearward linear arrays used in the system of arrays of the invention.

Referring to FIG. 6, graphs for characteristic frequency response curves for loudspeaker units 12 and sub-woofer units 52 are shown. Graph 61 is for sub-woofer units 52, showing a low frequency knee of about 25 Hz and a high frequency knee of about 110 Hz. Graph 63 is for loudspeaker units 12 and gives a low frequency knee of about 85 Hz and a high frequency knee of 20 KHz. The overlap between the high frequency knee of the low frequency units and the low frequency knee of the high frequency units is believed important in obtaining the higher directivity results achieved by the present invention.

Figure 7:
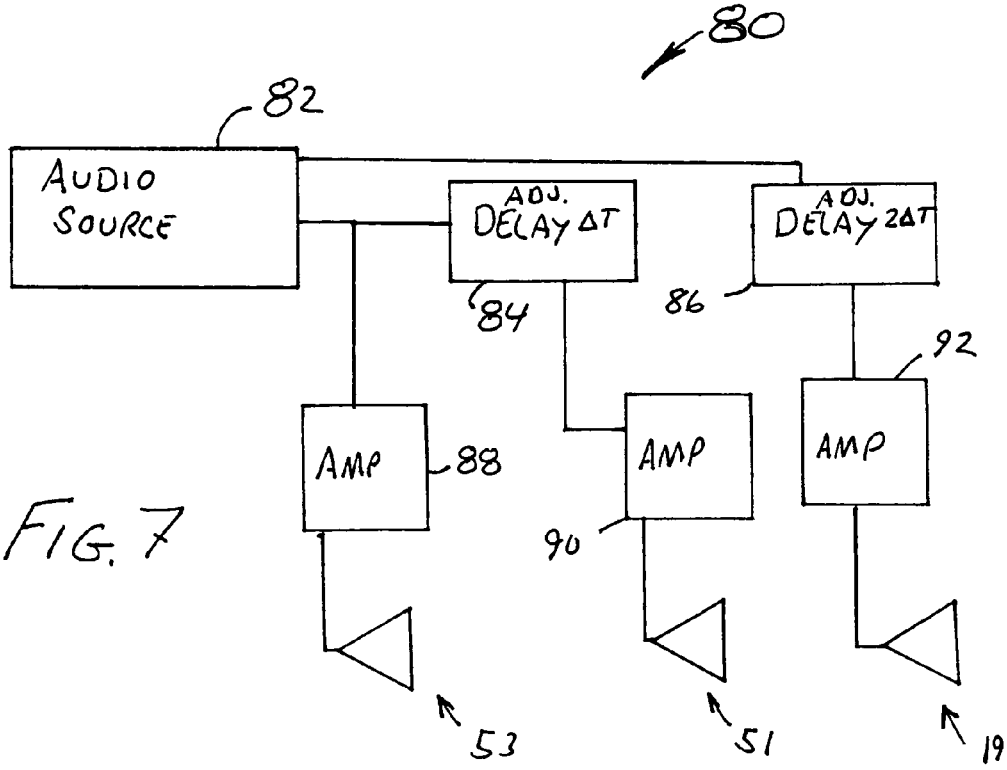
FIG. 7 is a block diagram schematic of a circuit which supplies audio drive signals to the linear arrays of FIG. 4.

Referring to FIG. 7, a simplified block diagram of a circuit 80 for energizing the arrays of the preferred embodiment of the invention is illustrated. Essentially a common audio source 82 is used, which here may be taken to be parallel low and high frequency band pass filters which supply the appropriate frequency ranges over each of two channels. The output of one channel is supplied to array 53 by way of amplifier 88. The same channel is connected to energize array 51 through an adjustable delay line 84 and amplifier 90. The high frequency channel is coupled through adjustable delay line 86 and amplifier 92 to linear array 19. Delay line 84 applies a delay of $\Delta T$ to the signal. Delay line 86 applies a delay of $2\Delta T$ (assuming equidistant spacing between arrays) to the signal of the higher frequency channel. Obviously delays must be adjusted to correspond to actual distances between the linear arrays. Delay may be adjusted depending upon variations in the spacing between the linear arrays, variations in the speed of sound which varies with altitude/air pressure and to partially desynchronize the wavefronts to control the width of the sound field.

Figure 8:
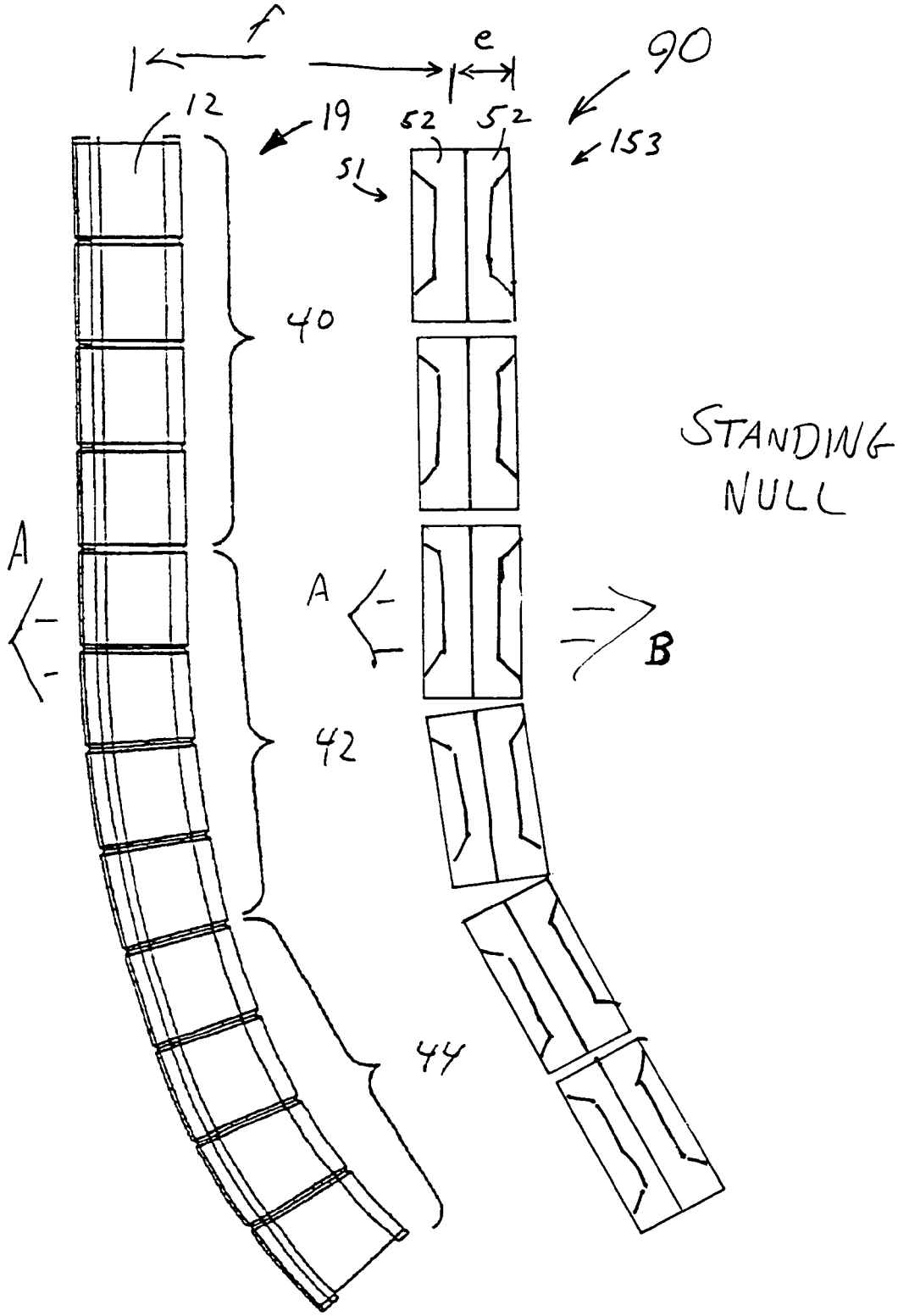
FIG. 8 is a side elevation of a second embodiment of the invention.
Figure 9:
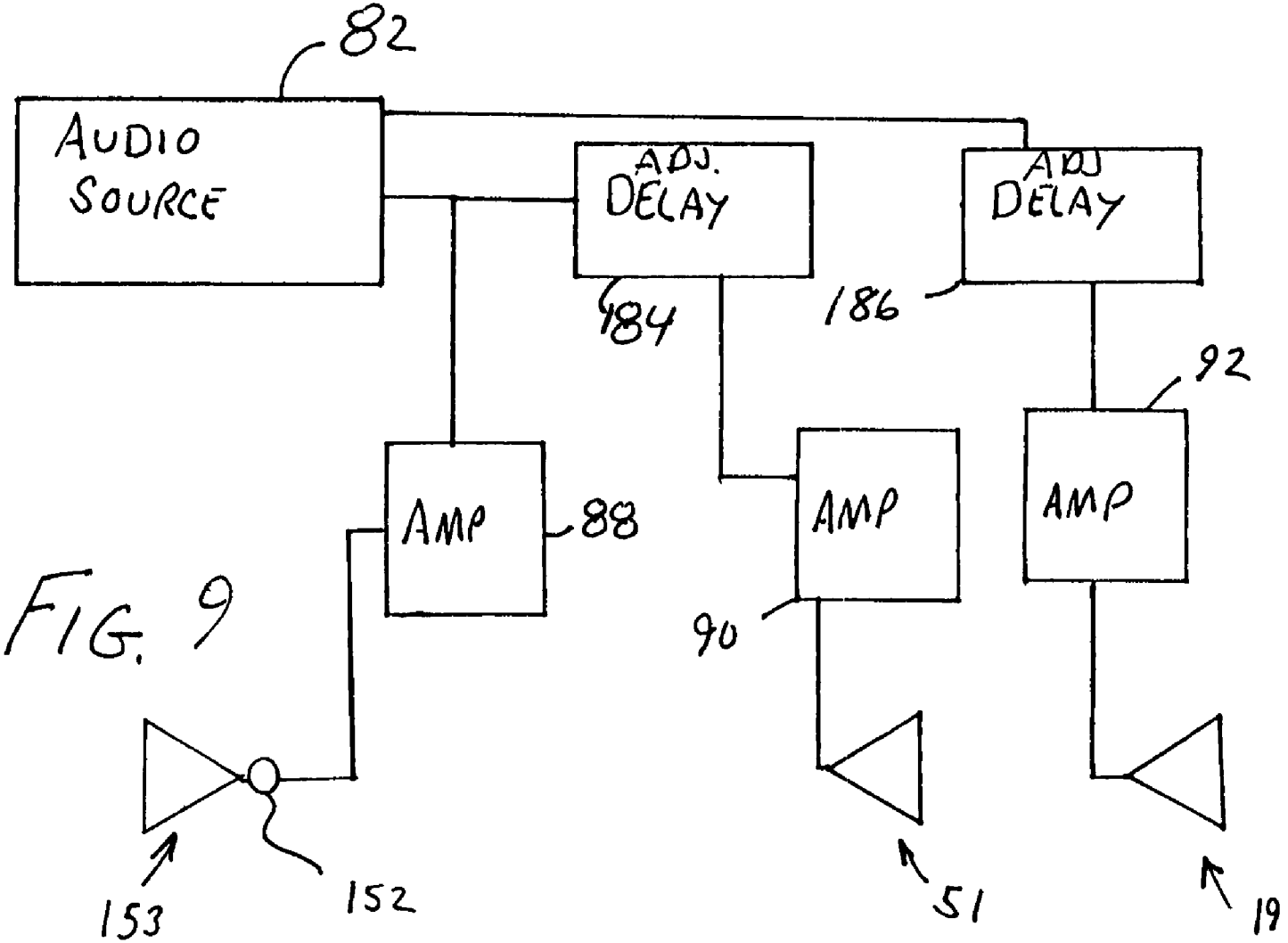
FIG. 9 is a block diagram schematic for a circuit which supplies audio signals to the linear arrays of FIG. 8.

Referring to FIG. 8 an alternative embodiment of the invention is illustrated. In order to obtain the benefit of a plurality of two linear arrays of bass units, without the expense of independently hanging the second linear array, it is possible to place a second array 153 back to back with the first array 51 in a joint assembly 90 of bass unit 52 oriented in the direction indicated by arrow B. This requires two electrical modifications to compensate for the change in spacing and the reversed orientation B of the rear array 153. As shown in FIG. 9, delays 184 and 186 are introduced to generate the correct delays for the distances "f" and "e". In additional the bass units 52 are linear array 153 are modified to have the opposite polarity 152 as do the bass unit 52 of linear array 51.

It is also possible to broaden the forward lobe by introducing a small mismatch to the time delay between arrays, so that the wavefront of the forward most array is slightly out of phase with the wavefront overtaking it from behind.

The invention provides an improved arrangement of linear arrays, comprising differentiated loudspeaker types, to produce a public loudspeaker system which achieves good directivity and improved efficiency over conventional arrangements of linear arrays.

While the invention is shown in only a few of its forms, it is not thus limited but is susceptible to various changes and modifications without departing from the spirit and scope of the invention.

What is claimed is:

1. A multi-element loudspeaker system comprising:

at least first and second linear arrays of loudspeakers arranged in tandem to radiate sound in a forward direction, the first linear array being spaced from and forward with respect to the second linear array; and the loudspeakers of the first linear array being of a first type which comprises transducer elements selected to operate in mid to high frequency ranges having a lower knee frequency, and the loudspeakers of the second linear array being of a second type comprising transducer elements selected to operate in a low frequency range and having an upper knee frequency, the lower knee frequency being lower than the upper knee frequency for producing a cardiod sound field centered on the plane of the first and second arrays.

2. A multi-element loudspeaker system as claimed in claim 1, further comprising:

delay means for synchronizing the wave fronts from the first linear array to the wave front from the second linear array.

3. A multi-element loudspeaker system as claimed in claim 2, further comprising:

at least a third linear array, comprising loudspeakers of the second type, disposed in tandem with and behind the second linear array.

4. A multi-element loudspeaker system as claimed in claim 3, further comprising:

the third linear array being acoustically behind and spaced from the second array with its loudspeakers oriented in the forward direction.

5. A multi-element loudspeaker system as claimed in claim 4, further comprising:

the spacing between the second and third linear arrays being substantially the same as the spacing between the first and second linear arrays.

6. A multi-element loudspeaker system as claimed in claim 5, further comprising:

the spacing between the second and third linear arrays being greater than the spacing between the first and second linear arrays.

7. A multi-element loudspeaker system as claimed in claim 3, further comprising:

the third linear array being located acoustically behind and directly adjacent to the second linear array as part of a common assembly with the loudspeakers of the third linear array being oppositely directed to those of the second and first linear arrays; and means for driving the loudspeakers of the third linear array exactly out of phase with the loudspeakers of the second linear array.

8. A multi-element loudspeaker system as claimed in claim 2, further comprising:

the delay means allowing adjustment of the delay periods to partially desynchronize the wavefronts from the linear arrays.

9. A sound reproduction system comprising:

first and second linear arrays of loudspeakers arranged one behind the other to radiate sound in a forward direction, the first linear array being located forward from the second linear array;

the second linear array being constructed from a plurality of loudspeaker units having a frequency response range covering the lower frequency components of the overall frequency range of sound reproduction system; and the first linear array being constructed from a plurality of loudspeaker units having a frequency response range covering the higher frequency components of overall range;

where the lower response ranges of the loudspeakers of the first linear array have knee frequencies of approximately 85 Hz and the upper response ranges of the loudspeakers of the second linear array have knee frequencies of approximately 110 Hz so that the ranges of the first linear array overlap the ranges of the second linear array for producing a cardioid sound field.

10. A sound reproduction system as set forth in claim 9, further comprising:

an energization circuit for the first and second linear arrays including a delay element controlling to degree of synchronization of the wavefronts from the first and second arrays.

11. A sound reproduction system as set forth in claim 10, further comprising:

at least a third linear array, comprising loudspeakers of the type used in the second linear array, disposed in tandem with and behind the second linear array.

12. A sound reproduction system as set forth in claim 11, further comprising:

the third linear array being acoustically behind and spaced from the second array with its loudspeakers oriented in the forward direction.

13. A sound reproduction system as set forth in claim 12, further comprising:

the spacing between the second and third linear arrays being substantially the same as the spacing between the first and second linear arrays.

14. A sound reproduction system as set forth in claim 13, further comprising:

the spacing between the second and third linear arrays being greater than the spacing between the first and second linear arrays.

15. A multi-element loudspeaker system as claimed in claim 11, further comprising:

the third linear array being located acoustically behind and directly adjacent to the second linear array as part of a common assembly with the loudspeakers of the third linear array being oppositely directed to those of the second and first linear arrays; and means for driving the loudspeakers of the third linear array exactly out of phase with the loudspeakers of the second linear array.

* * * * *